US006382721B1

(12) United States Patent
Young

(10) Patent No.: US 6,382,721 B1
(45) Date of Patent: May 7, 2002

(54) PORTABLE BENCH DEVICE

(76) Inventor: Wilbur A. Young, 4026 Robinwood Rd., York, PA (US) 17402

( * ) Notice: Subject to any disclaimer, the term of this patent is extended or adjusted under 35 U.S.C. 154(b) by 20 days.

(21) Appl. No.: 09/633,570

(22) Filed: Aug. 4, 2000

(51) Int. Cl.[7] ..... A47C 1/08
(52) U.S. Cl. ..... 297/250.1; 297/252
(58) Field of Search ..... 297/250.1, 252, 297/256, 256.16, 118, 129, 130, 217.7, 134, 255, 352, 353

(56) References Cited

U.S. PATENT DOCUMENTS

| | | | | |
|---|---|---|---|---|
| 962,468 A | | 6/1910 | Richardson | |
| 1,515,564 A | * | 11/1924 | Field | 297/250.1 |
| 1,852,012 A | * | 4/1932 | Hose | 297/250.1 X |
| D121,266 S | * | 7/1940 | Archer | 297/250.1 X |
| 2,843,348 A | | 7/1958 | Samuels | |
| 2,873,792 A | * | 2/1959 | Miralles | 297/250.1 |
| 3,994,529 A | | 11/1976 | Lippert | |
| 5,462,334 A | | 10/1995 | Sedorcek et al. | |
| 5,625,974 A | | 5/1997 | Demaio | |
| D390,370 S | | 2/1998 | Grosfillex | |
| 5,934,751 A | * | 8/1999 | Johnson et al. | 297/252 |

FOREIGN PATENT DOCUMENTS

| | | | | |
|---|---|---|---|---|
| CH | 129832 | * | 1/1929 | 297/252 |
| GB | 375959 | * | 7/1932 | 297/252 |

* cited by examiner

*Primary Examiner*—Peter M. Cuomo
*Assistant Examiner*—Stephen Vu

(57) ABSTRACT

A portable bench device for placement between railing portions on a bridge. The portable bench device includes a panel. The panel has a top surface, a bottom surface, a front edge, a back edge, a first side edge and a second side edge. The panel comprises a substantially rigid material. A back rest is pivotally coupled to the panel and positioned generally adjacent to the back edge of the panel. The back rest is selectively pivotable between a generally horizontal position abutting the top surface of the panel and a generally vertical position. A mounting member is securely coupled to the top surface of the panel and positioned generally adjacent to the front edge of the panel. The mounting member is positionable between portions of railing.

10 Claims, 2 Drawing Sheets

PORTABLE BENCH DEVICE

BACKGROUND OF THE INVENTION

1. Field of the Invention

The present invention relates to bench devices and more particularly pertains to a new portable bench device for placement between railing portions on a bridge.

2. Description of the Prior Art

The use of bench devices is known in the prior art. More specifically, bench devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,625,974; U.S. Pat. No. 3,994,529; U.S. Pat. No. 962,468; U.S. Pat. No. 5,462,334; U.S. Pat. No. 2,843,348; and U.S. Des. Pat. No. 390,370.

While these devices fulfill their respective, particular objectives and requirements, the aforementioned patents do not disclose a new portable bench device. The inventive device includes a panel. The panel has a top surface, a bottom surface, a front edge, a back edge, a first side edge and a second side edge. The panel comprises a substantially rigid material. A back rest is pivotally coupled to the panel and positioned generally adjacent to the back edge of the panel. The back rest is selectively pivotable between a generally horizontal position abutting the top surface of the panel and a generally vertical position. A mounting member is securely coupled to the top surface of the panel and positioned generally adjacent to the front edge of the panel. The mounting member is positionable between portions of railing.

In these respects, the portable bench device according to the present invention substantially departs from the conventional concepts and designs of the prior art, and in so doing provides an apparatus primarily developed for the purpose of placement between railing portions on a bridge.

SUMMARY OF THE INVENTION

In view of the foregoing disadvantages inherent in the known types of bench devices now present in the prior art, the present invention provides a new portable bench device construction wherein the same can be utilized for placement between railing portions on a bridge.

The general purpose of the present invention, which will be described subsequently in greater detail, is to provide a new portable bench device apparatus and method which has many of the advantages of the bench devices mentioned heretofore and many novel features that result in a new portable bench device which is not anticipated, rendered obvious, suggested, or even implied by any of the prior art bench devices, either alone or in any combination thereof.

To attain this, the present invention generally comprises a panel. The panel has a top surface, a bottom surface, a front edge, a back edge, a first side edge and a second side edge. The panel comprises a substantially rigid material. A back rest is pivotally coupled to the panel and positioned generally adjacent to the back edge of the panel. The back rest is selectively pivotable between a generally horizontal position abutting the top surface of the panel and a generally vertical position. A mounting member is securely coupled to the top surface of the panel and positioned generally adjacent to the front edge of the panel. The mounting member is positionable between portions of railing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable bench device apparatus and method which has many of the advantages of the bench devices mentioned heretofore and many novel features that result in a new portable bench device which is not anticipated, rendered obvious, suggested, or even implied by any of the prior art bench devices, either alone or in any combination thereof.

It is another object of the present invention to provide a new portable bench device which may be easily and efficiently manufactured and marketed.

It is a further object of the present invention to provide a new portable bench device which is of a durable and reliable construction.

An even further object of the present invention is to provide a new portable bench device which is susceptible of a low cost of manufacture with regard to both materials and labor, and which accordingly is then susceptible of low prices of sale to the consuming public, thereby making such portable bench device economically available to the buying public.

Still yet another object of the present invention is to provide a new portable bench device which provides in the apparatuses and methods of the prior art some of the advantages thereof, while simultaneously overcoming some of the disadvantages normally associated therewith.

Still another object of the present invention is to provide a new portable bench device for placement between railing portions on a bridge.

Yet another object of the present invention is to provide a new portable bench device which includes a panel. The panel has a top surface, a bottom surface, a front edge, a back edge, a first side edge and a second side edge. The panel comprises a substantially rigid material. A back rest is pivotally coupled to the panel and positioned generally adjacent to the back edge of the panel. The back rest is selectively pivotable between a generally horizontal position abutting the top surface of the panel and a generally vertical position. A mounting member is securely coupled to the top surface of the panel and positioned generally adjacent to the front edge of the panel. The mounting member is positionable between portions of railing.

Still yet another object of the present invention is to provide a new portable bench device that allows a user to fish from a bridge in a comfortable position.

Even still another object of the present invention is to provide a new portable bench device that is portable and has biasing means for use between different rail portions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
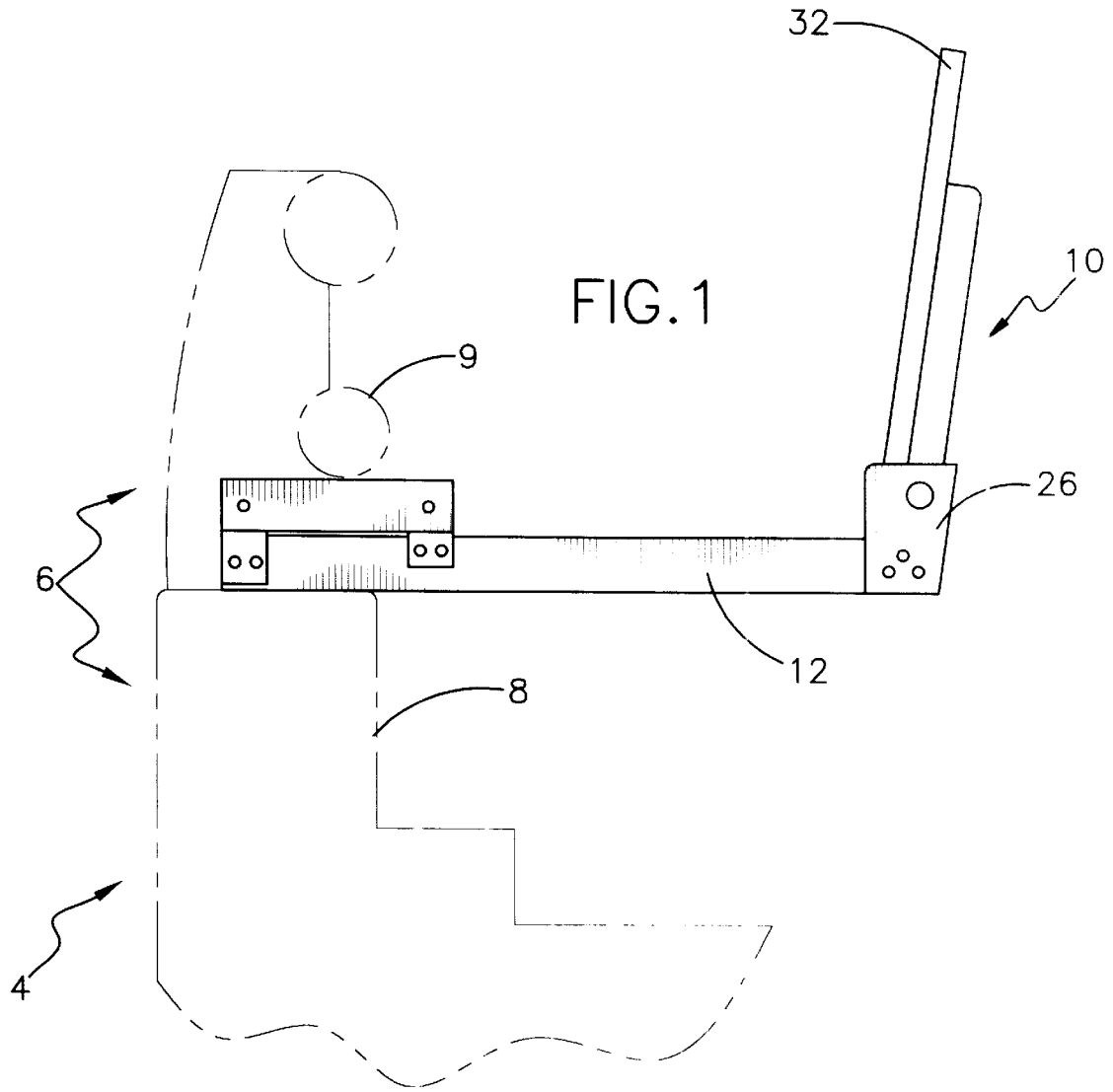
FIG. 1 is a schematic side view of a new portable bench device according to the present invention.

With reference now to the drawings, and in particular to FIGS. 1 through 4 thereof, a new portable bench device embodying the principles and concepts of the present invention and generally designated by the reference numeral 10 will be described.

As best illustrated in FIGS. 1 through 4, the portable bench device 10 generally comprises a device that is positionable between spaced portions 6 of a railing 4. Ideally, the railing portions 6 are a wall 8 and a rail 9 as is typically found on a bridge.

The device includes a panel 12. The panel 12 has a top surface 14, a bottom surface 16, a front edge 18, a back edge 20, a first side edge 22 and a second side edge 24. The panel 12 comprises a substantially rigid material such as wood or a metal material. The panel 12 preferably has a length generally between 24 inches and 36 inches and a width generally between 7 inches and 12 inches. The panel 12 ideally has a height between 1 and 3 inches.

Each of a pair of brackets 26 has a first wall 28 and a second wall 30 coupled together at an peripheral edge. Each of the first walls 28 is securely attached to one of the side edges 22, 24 of the panel 12 such that each of the second walls 30 are positioned generally adjacent to the back edge 20 of the panel 12. Each of the brackets 26 extends vertically away from the top surface 14. The top surface 14 and each of the second walls 30 form an angle. The angle is preferably between 90 degrees and 105 degrees and is ideally 95 degrees.

Figure 2:
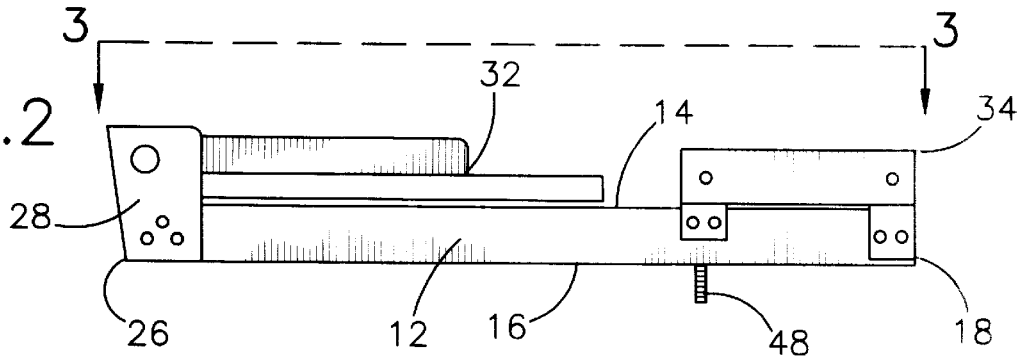
FIG. 2 is a schematic side view of the present invention.
Figure 3:
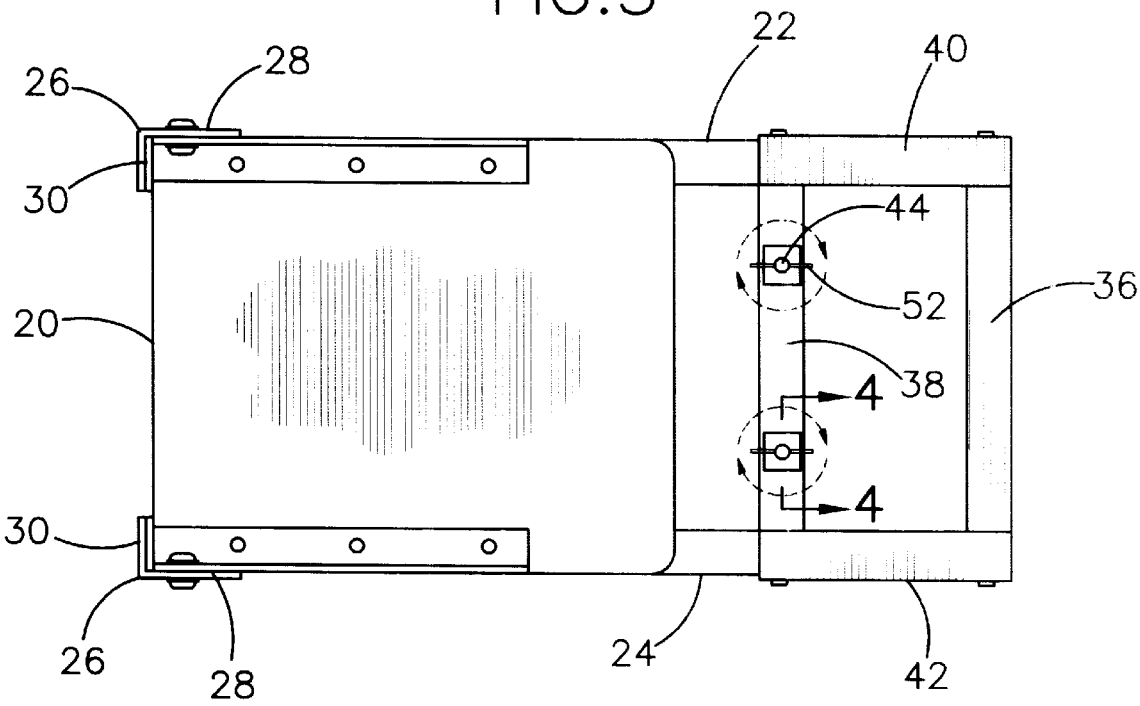
FIG. 3 is a schematic plan view of the present invention.
Figure 4:
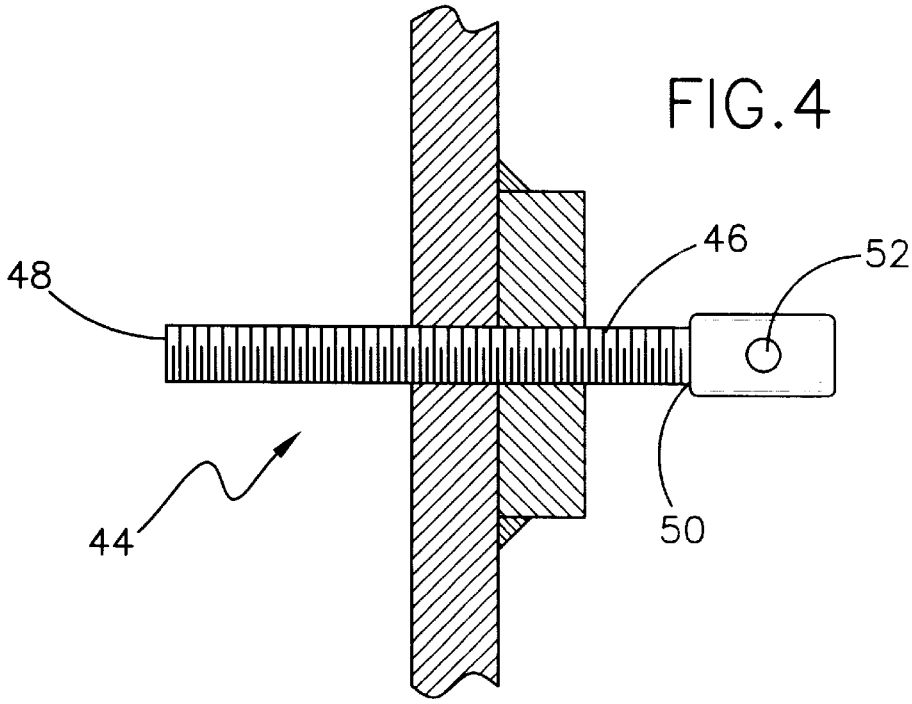
FIG. 4 is a schematic cross-sectional view taken along line 4—4 of the present invention.

A back rest 32 comprises a plate. The plate extends between and is pivotally coupled to each of the first walls 28. The back rest 32 is selectively pivotable between a generally horizontal position abutting the top surface of the panel as shown in FIG. 2 and a generally vertical position abutting each of the second walls 30 as is shown in FIG. 1.

A mounting member 34 is securely coupled to the top surface 14 of the panel 12 and is positioned generally adjacent to the front edge 18 of the panel 12. The mounting member 34 fills the void found between the panel 12 and rail 9 as shown in FIG. 1. The mounting member 34 comprises a first bar 36, a second bar 38, a third bar 40 and a fourth bar 42. The bars are integrally coupled together such that the mounting member 34 generally has a rectangular shape. The first bar 36 is generally adjacent to and is orientated generally perpendicular to the front edge 18 of the panel 12. The first 36 and second 38 bars are orientated generally perpendicular to each other. The first 36 and second 38 bars have height generally less than one-half a height of the third 40 and fourth 42 bars. The height of the third 40 and fourth 42 bars is generally equal to the height of the panel 12. The third 40 and fourth 42 bars preferably have a length generally between 4 and 8 inches.

A biasing means 44 biases the panel between opposed portions 6 of the railing. The biasing means 44 is extendable through the second bar 38 and the panel 12. The biasing means 44 comprises a pair of screws 46 having a first end 48 and a second end 50 wherein the first ends 48 are extendable through the second bar 38 and the panel 12. Each of a pair of rods 52 is attached in perpendicular relationship to one of the second ends 50 of the screws 46. The second bar 38 has a height less than a height of the third 40 and fourth 42 bars such that the biasing means 44 does not extend above the third 40 and fourth 42 bars to interfere with the railing 9.

In use, the mounting member 34 is placed between the wall 8 and the rail 9 of a bridge. The biasing means 44 are turned to bias the mounting member 34 against the railing 9. The back rest 32 is then placed in a vertical position and the user sits on the panel 12 with their back against the back rest 32. The back rest 32 is generally positioned at an angle greater than 90 degrees with respect to the panel 12 for the comfort of the user. The device 10 is then used to fish from when fishing from a bridge.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable railing mountable bench device, said device being removably positioned between spaced portions of a railing, said device comprising:

a panel having a top surface, a bottom surface, a front edge, a back edge, a first side edge and a second side edge, said panel comprising a substantially rigid material;

a back rest being pivotally coupled to said panel and positioned generally adjacent to said back edge of said panel, wherein said back rest is selectively pivotable between a generally horizontal position abutting said top surface of said panel and a generally vertical position;

a mounting member being securely coupled to said top surface of said panel and positioned generally adjacent to said front edge of said panel, said mounting member being positionable between the spaced portions of the railing; and a biasing means for biasing said panel between opposed portions of the railing, said biasing means being extendable through said mounting member and said panel.

2. The portable railing mountable bench device as in claim 1, wherein said panel has a length generally between 24 inches and 36 inches, said panel having a width generally between 7 inches and 12 inches, said panel having a height between 1 and 3 inches.

3. The portable railing mountable bench device as in claim 1, further comprising:

a pair of brackets, each of said brackets having a first wall and a second wall coupled together at an peripheral edge, each of said first walls being securely attached to one of said side edges of said panel such that each of said second walls are positioned generally adjacent to said back edge of said panel, each of said brackets extending vertically away from said top surface; and said back rest comprising a plate, said plate extending between and being pivotally coupled to each of said first walls, said back rest being selectively pivotable between a generally horizontal position abutting said top surface of said panel and a generally vertical position abutting each of said second walls.

4. The portable railing mountable bench device as in claim 3, wherein an angle being formed by said top surface and each of said second walls is generally between 90 degrees and 105 degrees.

5. The portable railing mountable bench device as in claim 4, further comprising:

said mounting member comprising a first bar, a second bar, a third bar and a fourth bar, said bars being integrally coupled together such that said mounting member generally has a rectangular shape, said first bar being generally adjacent to and orientated generally perpendicular to said front edge of said panel, said first and second bars being orientated generally perpendicular to each other.

6. The portable railing mountable bench device as in claim 5, wherein said biasing means comprises a pair of screws having a first end and a second end wherein said first ends are extendable through said second bar and said panel, each of a pair of rods being attached in perpendicular relationship to one of said second ends of said screws.

7. The portable railing mountable bench device as in claim 1, wherein said mounting member comprises a first bar, a second bar, a third bar and a fourth bar, said bars being integrally coupled together such that said mounting member generally has a rectangular shape, said first bar being generally adjacent to and orientated generally perpendicular to said front edge of said panel, said first and second bars being orientated generally perpendicular to each other.

8. The portable railing mountable bench device as in claim 7, wherein said biasing means comprises a pair of screws having a first end and a second end wherein said first ends are extendable through said second bar and said panel, each of a pair of rods being attached in perpendicular relationship to one of said second ends of said screws.

9. A portable railing mountable bench device, said device being removably positioned between spaced portions of a railing, said device comprising:

a panel having a top surface, a bottom surface, a front edge, a back edge, a first side edge and a second side edge, said panel comprising a substantially rigid material, said panel having a length generally between 24 inches and 36 inches, said panel having a width generally between 7 inches and 12 inches, said panel having a height between 1 and 3 inches;

a pair of brackets, each of said brackets having a first wall and a second wall coupled together at an peripheral edge, each of said first walls being securely attached to one of said side edges of said panel such that each of said second walls are positioned generally adjacent to said back edge of said panel, each of said brackets extending vertically away from said top surface, an angle being formed by said top surface and each of said second walls being generally between 90 degrees and 105 degrees;

a back rest comprising a plate, said plate extending between and being pivotally coupled to each of said first walls, said back rest being selectively pivotable between a generally horizontal position abutting said top surface of said panel and a generally vertical position abutting each of said second walls;

a mounting member being securely coupled to said top surface of said panel and positioned generally adjacent to said front edge of said panel, said mounting member comprising a first bar, a second bar, a third bar and a fourth bar, said bars being integrally coupled together such that said mounting member generally has a rectangular shape, said first bar being generally adjacent to and orientated generally perpendicular to said front edge of said panel, said first and second bars being orientated generally perpendicular to each other, said first and second bars having height generally less than one-half a height of said third and fourth bars, said height of said third and fourth bars being generally equal to said height of said panel, said third and fourth bars having a length generally between 4 and 8 inches;

a biasing means for biasing said panel between opposed portions of the railing, said biasing means being extendable through said second bar and said panel, said biasing means comprising a pair of screws having a first end and a second end wherein said first ends are extendable through said second bar and said panel, each of a pair of rods being attached in perpendicular relationship to one of said second ends of said screws.

10. A portable railing mountable bench device, said device being removably positioned between spaced portions of a railing, said device comprising:

a panel having a top surface, a bottom surface, a front edge, a back edge, a first side edge and a second side edge, said panel comprising a substantially rigid material;

a back rest being pivotally coupled to said panel and positioned generally adjacent to said back edge of said panel, wherein said back rest is selectively pivotable between a position in which said back rest is oriented generally parallel to said top surface of said panel and a position in which said back rest extends generally perpendicular to said top surface of said panel;

a mounting member being coupled to said top surface of said panel and positioned generally adjacent to said front edge of said panel, said mounting member being positionable between the spaced portions of the railing; and a biasing means for biasing said panel between opposed portions of the railing, said biasing means being extendable through said mounting member and said panel.

* * * * *